US007207872B2

(12) United States Patent
Lamprecht et al.

(10) Patent No.: US 7,207,872 B2
(45) Date of Patent: Apr. 24, 2007

(54) BEARING ARRANGEMENT FOR VIBRATIONALLY MOUNTING A GRINDING DISK IN A GRINDER

(75) Inventors: Justus Lamprecht, Dusslingen (DE); Tobias Lutz, Filderstadt (DE); Christoph Cramer, Aichtal (DE)

(73) Assignee: Robert Bosch GmbH, Stuttgart (DE)

( * ) Notice: Subject to any disclaimer, the term of this patent is extended or adjusted under 35 U.S.C. 154(b) by 103 days.

(21) Appl. No.: 10/516,585

(22) PCT Filed: Jul. 11, 2003

(86) PCT No.: PCT/DE03/02337

§ 371 (c)(1),
(2), (4) Date: Dec. 2, 2004

(87) PCT Pub. No.: WO2004/041478

PCT Pub. Date: May 21, 2004

(65) Prior Publication Data

US 2005/0164615 A1 Jul. 28, 2005

(30) Foreign Application Priority Data

Nov. 6, 2002 (DE) ..... 102 51 556

(51) Int. Cl.
*B24B 23/04* (2006.01)

(52) U.S. Cl. ..... 451/356

(58) Field of Classification Search ..... 451/356
See application file for complete search history.

(56) References Cited

U.S. PATENT DOCUMENTS 2,848,850 A * 8/1958 Metoff ..... 451/344
2,885,833 A * 5/1959 Neff ..... 451/356
3,336,702 A * 8/1967 Enders ..... 451/356
3,345,784 A * 10/1967 Stelljes et al. ..... 451/357
3,815,292 A * 6/1974 Hutchins ..... 451/357
3,849,943 A 11/1974 Thomas et al.
3,862,520 A 1/1975 Klebe, Jr. et al.
3,918,214 A 11/1975 Buschman
4,095,375 A * 6/1978 Klebe et al. ..... 451/357
4,397,120 A 8/1983 Overy et al.
4,549,371 A * 10/1985 Hakoda ..... 451/456
4,837,981 A * 6/1989 Hashii ..... 451/357
5,967,886 A * 10/1999 Wuensch et al. ..... 451/356
6,780,094 B2 * 8/2004 Walker ..... 451/356
7,052,383 B2 * 5/2006 Sieber ..... 451/354

FOREIGN PATENT DOCUMENTS

EP 1 166 963 A1 1/2002

* cited by examiner

*Primary Examiner*—M. Rachuba
(74) *Attorney, Agent, or Firm*—Michael J. Striker

(57) ABSTRACT

The invention is based on a bearing arrangement for vibratingly supporting a grinding disk (24) on a grinding apparatus (10), in particular in a vibrating grinder, having a plurality of elastic vibration bodies (48), which can be connected on the one hand to the grinding disk (24) and on the other to the grinding apparatus (10). It is proposed that the vibration bodies (48) are disposed, individually or in groups of a plurality of vibration bodies (48) each, in a plurality of modules (42) that are separate from one another.

15 Claims, 4 Drawing Sheets

BEARING ARRANGEMENT FOR VIBRATIONALLY MOUNTING A GRINDING DISK IN A GRINDER

CROSS-REFERENCE

The invention described and claimed hereinbelow is also described in PCT/DE 03/02337, filed Jul. 11, 2003 and DE 102 51 556.5, filed Nov. 6, 2002. This German Patent Application, whose subject matter is incorporated here by reference, provides the basis for a claim of priority of invention under 35 U.S.C. 119 (a)–(d).

BACKGROUND OF THE INVENTION

The invention is based on a bearing arrangement for vibratingly supporting a grinding disk on a grinding apparatus, in particular a ¼-blade vibrating grinder.

In conventional vibrating grinders, the grinding disk is driven to execute lateral vibrating motions by an eccentric; the grinding disk is connected to the grinding apparatus by elastic vibration legs.

The vibration legs prevent the rotary motion of the eccentric from being transmitted to the grinding disk, on the one hand, and thus form a means of securing the grinding disk against relative rotation.

On the other hand, the vibration legs absorb the contact pressure acting on the grinding disk and carry it onward to the grinding apparatus.

Finally, upon their torsion-caused deformation, the vibration legs are intended to dissipate as little vibrational energy, in the form of energy of deformation, as possible so as to economize on electrical energy for driving purposes; this is especially important for grinding apparatuses operated by rechargeable batteries, because of the limited capacity of such batteries.

Conventionally, the vibration legs are joined together by a plastic bridge and form a unitary component, so that all the vibration legs are mounted together with the plastic bridge.

In grinding apparatuses with integrated removal of dust by vacuum, however, the installation space for the vibration legs is very limited, so that such plastic bridges with a plurality of vibration legs cannot be installed.

SUMMARY OF THE INVENTION

By comparison, the invention provides a bearing arrangement for vibratingly supporting a grinding disk on a grinding apparatus in which the vibration legs are each disposed individually or in groups of a plurality of vibration legs in a plurality of separate modules.

Dividing up the individual vibration legs among a plurality of modules offers the advantage that for mounting in a grinding apparatus, less mounting space is needed, since the modules can each be installed individually.

Preferably, each module has three vibration legs, but the individual vibration legs may also be divided up among the individual modules in some other way. For instance, each module may have one, two, or four vibration legs.

In the bearing arrangement of the invention, the elastic connection of the grinding disk to the grinding apparatus need not necessarily be done by means of vibration legs, however, whose length is substantially greater than their thickness. Instead, it is also possible to use vibration bodies of some other design, as long as the vibration bodies form an elastic connection between the grinding disk and the grinding apparatus.

Moreover, the bearing arrangement of the invention can be used not only in a grinding apparatus but also in a polishing apparatus, in which a polishing disk is driven to execute lateral vibrational motions by an eccentric. The bearing arrangement of the invention then connects the polishing disk to the polishing apparatus in a manner capable of vibration.

In a preferred embodiment of the invention, the individual modules have a bayonet mount for mounting them on the grinding apparatus. Securing the individual modules is thus preferably done by slipping the individual modules on and then displacing them or twisting them, so that mounting can be done without a tool.

Preferably, the individual modules each have one groove and/or one tongue, so that adjacent modules, in the mounted state, form a tongue-and-groove connection. This offers the advantage that the strength of the bearing arrangement of the invention, despite being divided up among a plurality of modules, is similar in quality to conventional bearing arrangements with a plastic bridge for connecting the individual vibration legs.

The individual modules preferably have a mounting body for fastening to the grinding apparatus and a guide body for guiding the grinding disk; the mounting body is joined to the guide body by at least one of the vibration bodies. The guide body with the grinding disk can thus execute vibrational motions relative to the mounting body, motions that are generated for instance by an eccentric.

Preferably, for being screwed to the grinding disk, the guide body has a screw receptacle, which may for instance comprise a simple blind bore that can be engaged on the inside by a fastening screw. Thus the fastening of the grinding disk is done by means of screws, which are screwed into the screw receptacle through the grinding disk from the workpiece side of the grinding disk.

To make mounting the grinding disk on a grinding apparatus with the bearing arrangement of the invention easier, the guide body, on its side toward the grinding disk, preferably has a protrusion which positively engages a suitably adapted fastening receptacle in the grinding disk.

Preferably, the protrusion on the guide body is non-round, in order to form a means of securing against relative rotation. When the grinding disk is screwed tightly to the bearing arrangement of the invention, the torque introduced into the guide body of the bearing arrangement by the fastening screw is then diverted into the grinding disk, via the positive-engagement connection, fixed against relative rotation, between the protrusion on the guide body and the fastening receptacle of the grinding disk.

In a preferred embodiment, the mounting body of the bearing arrangement of the invention is platelike and on one side edge has at least one recess for a suitably adapted tongue on the grinding apparatus. Upon installation, the individual modules are accordingly slipped onto the grinding apparatus in such a way that the tongue on the grinding apparatus engages the associated recess on the side edge of the module. Next, the modules are displaced, so that the tongue on the grinding apparatus is no longer located above the recess, but instead grasps the side edge of the mounting body and fixes it as a result. For disassembly, the module must then be displaced again such that the tongue is located above the recess in the side edge of the mounting body, whereupon the module can be simply taken off.

Moreover, in one embodiment of the invention, the mounting body has at least one protrusion, which in the mounted state forms a connection by frictional engagement with a suitably adapted receptacle on the grinding apparatus.

Preferably, this protrusion is immediately adjacent the recess in the side edge of the mounting body, so that upon displacement of the mounting body, a frictional or clamping action is created, whereby the module is fixed.

Furthermore, the mounting body, on the side toward the grinding apparatus and/or on the side remote from the grinding apparatus, has a tongue, which in the mounted state forms a tongue-and-groove connection with a suitably adapted groove on the grinding apparatus.

It should also be noted that the invention is not limited to the bearing arrangement described above but instead also encompasses a complete grinding or polishing apparatus with such a bearing arrangement.

BRIEF DESCRIPTION OF THE DRAWINGS

Further advantages will become apparent from the following description of the drawings. In the drawings, one exemplary embodiment of the invention is shown. The drawing, description and claims include numerous characteristics in combination. One skilled in the art will expediently consider the characteristics individually as well and put them together to make useful further combinations.

Shown are.

DETAILED DESCRIPTION OF THE PREFERRED EMBODIMENTS

Figure 1:
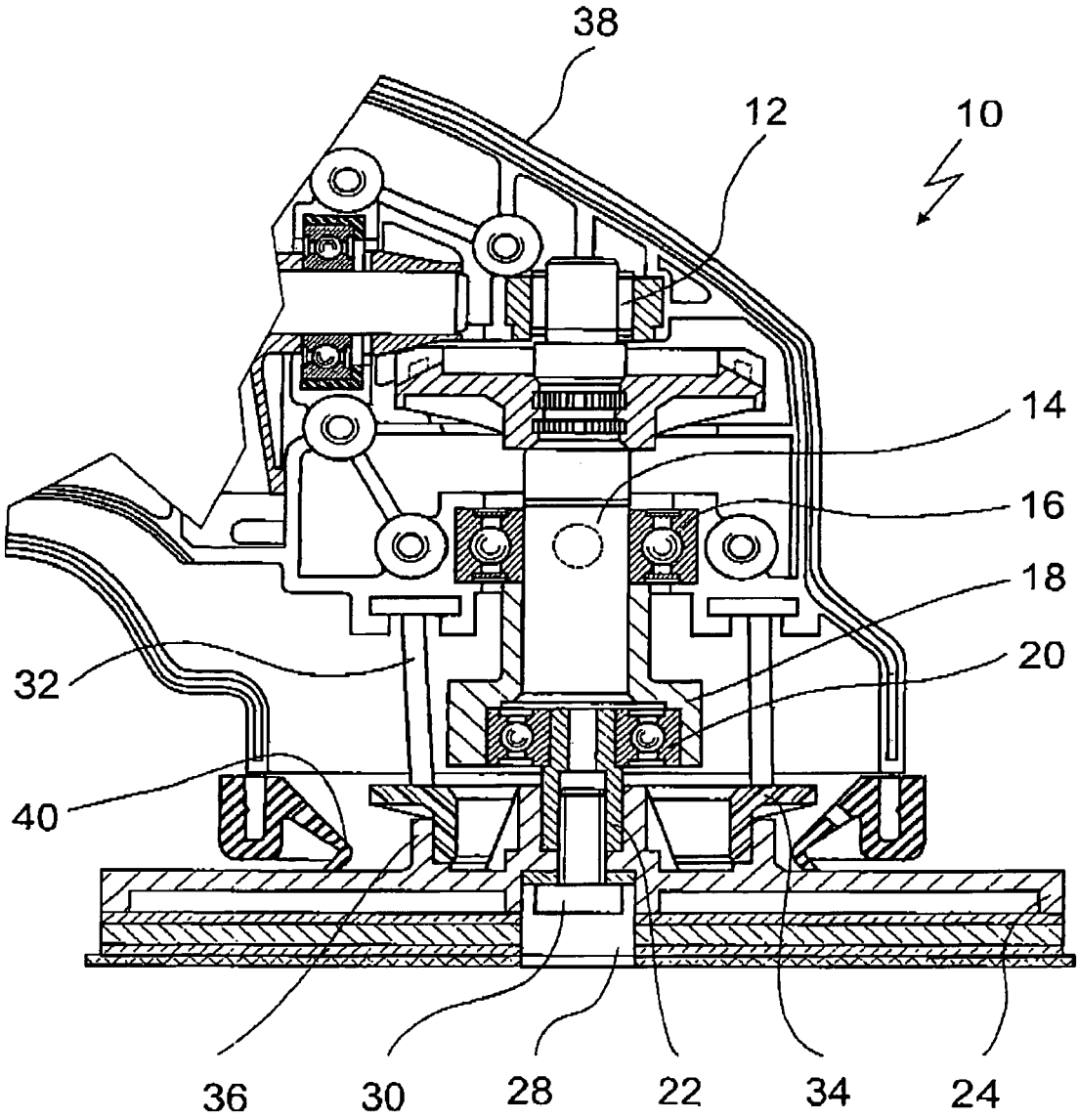
Fig. 1 PRIOR ART
FIG. 1, a sectional view through a conventional vibrating grinder.

The cross-sectional view in FIG. 1 shows a vibrating grinder 10, which is of conventional construction and will be described briefly below, in order then to address the special features of the invention.

The vibrating grinder 10 has an electric motor, which drives a power takeoff shaft 14; the power takeoff shaft 14 is additionally rotatably supported in a ball bearing 16.

The power takeoff shaft 14 has a free end onto which an eccentric sleeve 18 is press-fitted, so that the eccentric sleeve 18 is secured on the power takeoff shaft 14 in a manner fixed against relative rotation and fixed in the axial direction. Instead of the press fit employed here, however, the fastening of the eccentric sleeve 18 to the power takeoff shaft 14 may be done in some other way, such as by means of a screw connection.

The eccentric sleeve 18 accordingly rotates with the power takeoff shaft 14 and is therefore balanced relative to the power takeoff shaft 14, to avoid vibration in operation.

On its end toward the workpiece, the eccentric sleeve 18 furthermore has a cup-shaped, cylindrical receptacle for a ball bearing 20 with an inner ring and an outer ring; the receptacle for the ball bearing 20 is disposed eccentrically relative to the power takeoff shaft 14. The outer ring of the ball bearing 20 is pressed into the receptacle, while a sleevelike receptacle part 22 is press-fitted into the inner ring of the ball bearing 20.

Figure 2A:
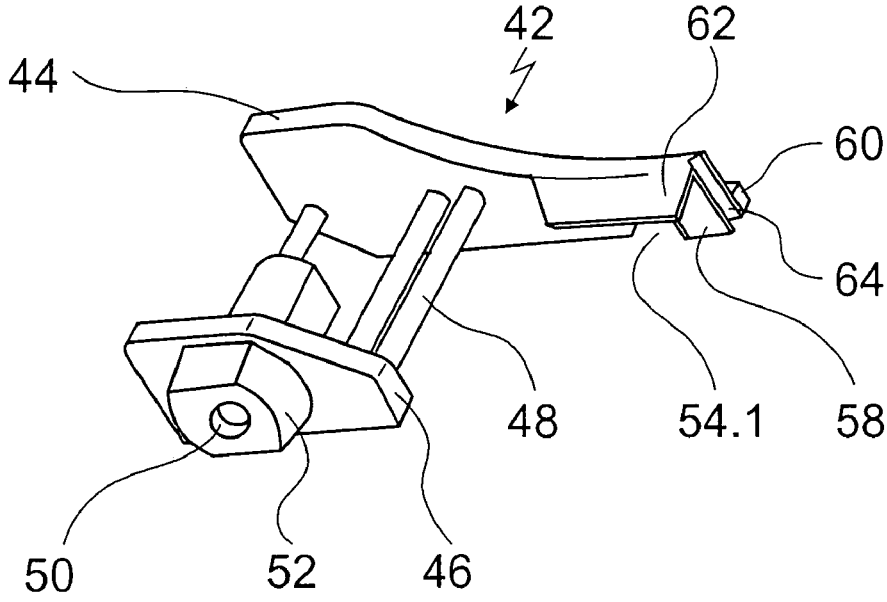
FIGS. 2*a*–2*c*, perspective views of a module of a bearing arrangement of the invention.
Figure 2B:
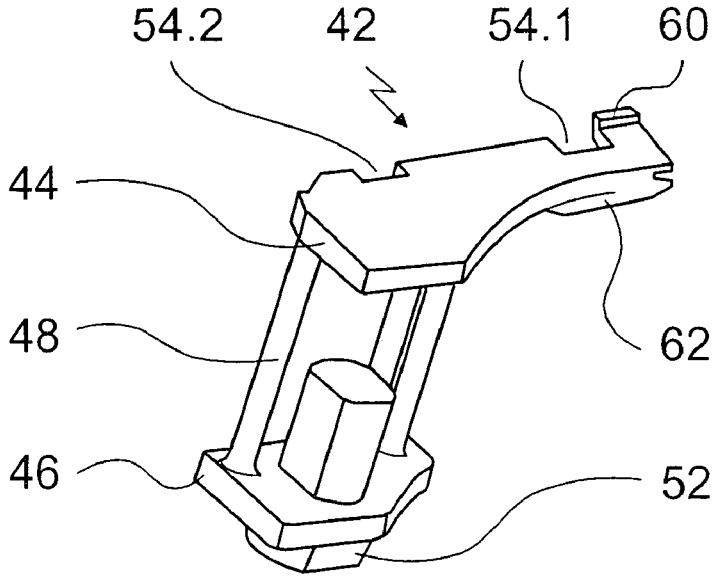
Figure 2C:
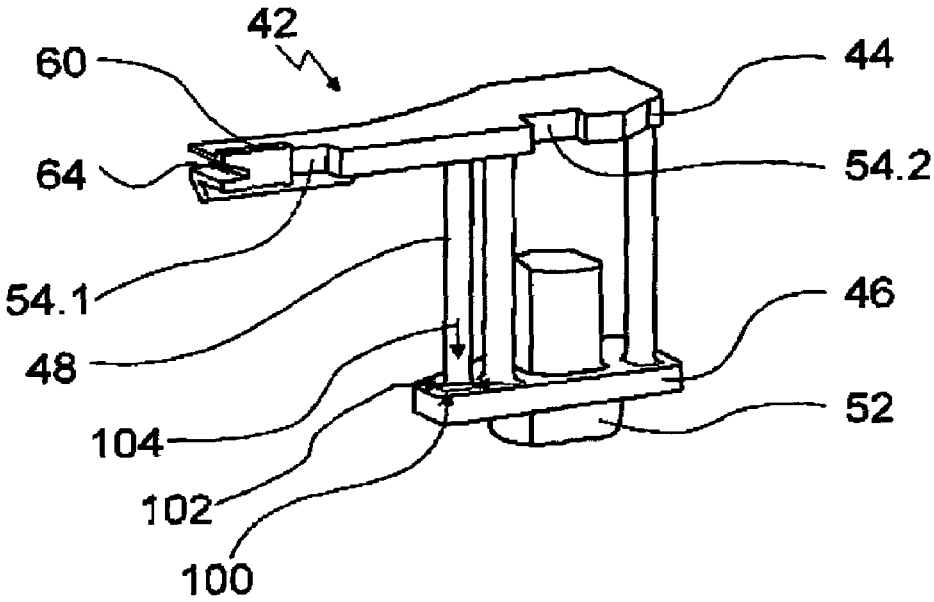

The sleevelike receptacle part 22 serves to secure a grinding disk 24, and for that purpose, on its end toward the tool, it has a female thread 26, as can be seen particularly in FIG. 2. For securing the grinding disk 24 to the grinding apparatus 10, the grinding disk has a mounting bore 28 in its middle region, through which bore a central fastening screw 30 can be screwed into the female thread 26 of the receptacle part 22. Securing the grinding disk 24 to the grinding apparatus 10 by a screw connection thus makes simple replacement of the grinding disk 24 possible, so that once suitable grinding disks 24 have been selected, either plane grinding or contour grinding can be selectively done with the same grinding apparatus 10.

Moreover, the grinding apparatus 10 has a plurality of elastic vibration legs 32 of polyoxymethylene (POM), which guide a guide element 34 in a manner that is secure against relative rotation but is laterally resilient. However, the vibration legs 32 may comprise other elastic, tough materials, which as much as possible exhibit no material fatigue whatever even after long periods of operation and frequent deformations; examples that can be named are polyamide (PA) and polypropylene (PP).

The guide element 34 engages the inside of an encompassing collar 36, formed integrally onto the top of the grinding disk 24, so that the freedom of motion of the grinding disk 24 is limited to plane-parallel motions. The encompassing collar 36 of the grinding disk 24 is accordingly non-round and is approximately triangular, as a result of which the grinding disk 24 is secured against twisting.

Accordingly, because of the eccentric bearing of the receptacle part 22 in the eccentric sleeve 18, a rotation of the power takeoff shaft 14 leads to plane-parallel grinding motions of the grinding disk 24.

The grinding apparatus 10 furthermore has a housing 38, which on its underside is flush with the top of the grinding disk 24 by means of a sealing lip 40.

FIGS. 2*a* through 2*c* and 3*a* and 3*b*, conversely, show a module of a four-part bearing arrangement that can be employed in a vibrating grinder similar to the vibrating grinder 10, instead of the guide element 34 with the vibration legs 32.

The module 42 has a mounting plate 44 and a guide plate 46, which are joined together by three elastic vibration legs 48; the mounting plate 44, guide plate 46, and vibration legs 48 are of plastic. Because of their elasticity, the three vibration legs 48 enable a lateral vibrational motion of the grinding disk 24 that is driven by the eccentric sleeve 18.

In the installed state, the guide plate 46 is joined to the grinding disk 24. To that end, the guide plate 46 has a screw receptacle 50, which is engaged in the installed state by a fastening screw, which by means of a screw connection connects the grinding disk 24 to the guide plate 46. The guide plate 46 furthermore, on its side toward the grinding disk 24, has a protrusion 52, which in the installed state engages a receptacle in the grinding disk 24 in order to establish a positive-engagement connection between the grinding disk 24 and the guide plate 46. The protrusion 52 here is non-round and has two flattened sides, thus forming a means of securing against relative rotation. This is advantageous, since in this way, when the fastening screw is tightened in the screw receptacle 50, the torque introduced into the guide plate 46 is diverted into the grinding disk 24 via the positive-engagement connection, secure against relative rotation, between the protrusion 52 and the associated receptacle in the grinding disk 24.

Figure 3A:
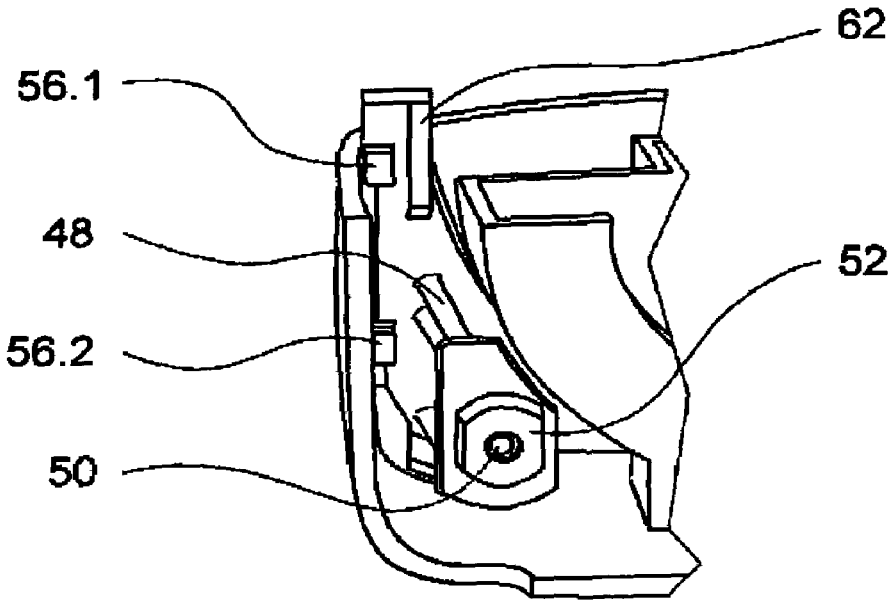
FIGS. 3*a*–3*b*, the module, shown in FIGS. 2*a* through 2*c*, in various positions during the installation.
Figure 3B:
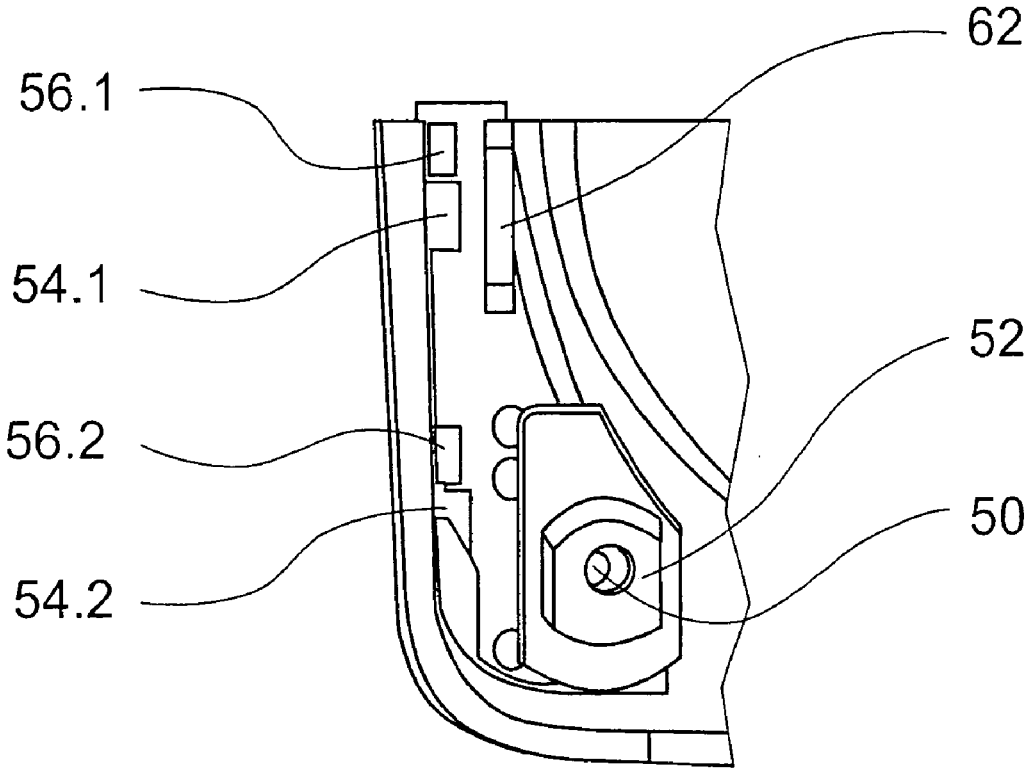

In the installed state, conversely, the mounting plate 44 of the module 42 is connected to the housing 38 of the grinding apparatus 10, as can be seen from FIGS. 3*a* and 3*b*. The connection between the mounting plate 44 and the housing 38 of the grinding apparatus 10 is effected by means of a bayonet mount, so that simple installation and disassembly of the module 42 without a tool is possible.

To this end, the mounting plate 44 has two recesses 54.1, 54.2 on one side edge, and these are engaged, in the mounting position shown in FIG. 3*a*, by two tongues 56.1, 56.2, so that the module 42 can be introduced into the housing 38 on the side toward the workpiece. In the process, the tongues 56.1, 56.2 slide through the associated recesses 54.1, 54.2 on the mounting plate 44.

Next, the module 42 is then thrust out of the mounting position shown in FIG. 3*a* into the final position shown in FIG. 3*b*; in the final position of the module 42, the tongues 56.1, 56.2 rest on the mounting plate 44 next to the recesses 54.1, 54.2 and thereby clamp the mounting plate 44 firmly.

To improve the clamping action between the tongues 56.1, 56.2 and the mounting plate 44, a protrusion 58, which in the final position of the module 42 presses against the tongue 54.1, is integrally formed onto the side of the mounting plate 44 toward the tongue 56.1, at the edge of the recess 54.1.

Moreover, two tongues 60, 62 are integrally formed onto the mounting plate 44 and guide the mounting plate 44 in the installed state; the tongue 60 engages a suitably adapted groove in the housing 38 of the grinding apparatus 10.

The mounting plate 44 of the module 42 also has a wedge-shaped groove 64, which is engaged in the mounted state by a suitably adapted tongue of an adjacent module, so that the individual modules of the bearing arrangement of the invention are connected mechanically to one another and can nevertheless be installed individually and therefore in a way that requires little space.

Overall, the bearing arrangement of the invention comprises four modules 42 that are mirror images of one another, and which each have either the groove 64 or a suitably adapted tongue.

The invention is not limited to the preferred exemplary embodiment described above. On the contrary, many variations and modifications may be made that also make use of the concept of the invention and are therefore within its patent scope.

| List of Reference Numerals | |
|---|---|
| 10 | Grinding apparatus |
| 14 | Power takeoff shaft |
| 16 | Ball bearing |
| 18 | Eccentric element |
| 20 | Ball bearing |
| 22 | Receptacle part |
| 24 | Grinding disk |
| 26 | Female thread |
| 28 | Mounting bore |
| 30 | Fastening screw |
| 32 | Vibration leg |
| 34 | Guide element |
| 36 | Collar |
| 38 | Housing |
| 40 | Sealing lip |
| 42 | Module of the bearing arrangement |
| 44 | Mounting plate |
| 46 | Guide plate |
| 48 | Vibration leg |
| 50 | Screw receptacle |
| 52 | Protrusion |
| 54.1, 54.2 | Recess |
| 56.1, 56.2 | Tongue |
| 58 | Protrusion |
| 60 | Tongue |
| 62 | Tongue |
| 64 | Groove |

The invention claimed is:

1. A bearing arrangement for vibratingly supporting a grinding disk (24) on a grinding apparatus (10), in particular in a vibrating grinder, having a plurality of elastic vibration bodies (48), which can be connected on the one hand to the grinding disk (24) and on the other to the grinding apparatus (10), wherein the vibration bodies (48) are disposed, in groups of a plurality of vibration bodies (48) each, in a plurality of modules (42) that are separate from one another, wherein the individual modules (42) each have one mounting body (44) for fastening to the grinding apparatus (10) and one guide body (46) for guiding the grinding disk (24), wherein the mounting body (44) is joined to the guide body (46)in a manner capable of vibration by means of at least one of the vibration bodies (48), wherein the mounting body (44) is platelike and the vibration bodies (48) are joined together by means of the mounting body (44), and wherein the guide body (46) is platelike and the vibration bodies (48) are joined together by means of the guide body (46).

2. The bearing arrangement of claim 1, wherein the individual modules (42) have a bayonet mount for mounting them on the grinding apparatus (10).

3. The bearing arrangement of claim 1, wherein the modules (42) each have one groove (64) and/or one tongue, in order in the mounted state to form a tongue-and-groove connection between adjacent modules (42).

4. The bearing arrangement of claim 1, wherein the guide body (46), of the individual modules (42) has a screw receptacle (50) for receiving a fastening screw.

5. The bearing arrangement of claim 1, wherein the guide body (48), for making a positive-engagement connection with a fastening receptacle in the grinding disk (24), has a suitably adapted protrusion (52) on its side toward the grinding disk (24).

6. The bearing arrangement of claim 5, wherein the protrusion (52) on the guide body (46) is non-round.

7. The bearing arrangement of claim 1, wherein the mounting body (44) is platelike and on one side edge has at least one recess (54.1, 54.2) for a suitably adapted tongue (56.1, 56.2) on the grinding apparatus (10).

8. The bearing arrangement of claim 7, wherein the platelike mounting body (44) has at least one protrusion (58), in order in the mounted state to form a frictional engagement connection with a friction face on the grinding apparatus (10).

9. The bearing arrangement of claim 1, wherein the mounting body (44), on the side toward the grinding apparatus (10) and/or on the side remote from the grinding apparatus (10), has a tongue (60, 62), which in the mounted state forms a tongue-and-groove connection with a suitably adapted groove on the grinding apparatus (10).

10. A grinding or polishing apparatus having a bearing arrangement of claim 1.

11. A bearing arrangement for vibratingly supporting a grinding disk (24) on a grinding apparatus (10), in particular in a vibrating grinder, having a plurality of elastic vibration bodies (48), which can be connected on the one hand to the grinding disk (24) and on the other to the grinding apparatus (10), characterized in that the vibration bodies (48) are disposed, individually or in groups of a plurality of vibration bodies (48) each, in a plurality of modules (42) that are separate from one another, wherein the modules (42) each have one groove (64) and/or one tongue, in order in the mounted state to form a tongue-and-groove connection between adjacent modules (42).

12. A bearing arrangement for vibratingly supporting a grinding disk (24) on a grinding apparatus (10), in particular in a vibrating grinder, having a plurality of elastic vibration bodies (48), which can be connected on the one hand to the grinding disk (24) and on the other to the grinding apparatus (10), characterized in that the vibration bodies (48) are disposed, individually or in groups of a plurality of vibration bodies (48) each, in a plurality of modules (42) that are separate from one another, wherein the individual modules (42) each have one mounting body (44) for fastening to the grinding apparatus (10) and one guide body (46) for guiding the grinding disk (24), and the mounting body (44) is joined to the guide body (46) In a manner capable of vibration by means of at least one of the vibration bodies (48), and wherein the mounting body (44) is platelike and on one side edge has at least one recess (54.1, 54.2) for a suitably adapted tongue (56.1, 56.2) on the grinding apparatus (10).

13. A bearing arrangement for vibratingly supporting a grinding disk (24) on a grinding apparatus (10), in particular in a vibrating grinder, having a plurality of elastic vibration bodies (48), which can be connected on the one hand to the grinding disk (24) and on the other to the grinding apparatus (10), characterized in that the vibration bodies (48) are disposed, individually or in groups of a plurality of vibration bodies (48) each, in a plurality of modules (42) that are separate from one another, wherein the individual modules (42) each have one mounting body (44) for fastening to the grinding apparatus (10) and one guide body (46) for guiding the grinding disk (24), and the mounting body (44)is joined to the guide body (46) in a manner capable of vibration by means of at least one of the vibration bodies (48), wherein the mounting body (44) is platelike and on one side edge has at least one recess (54.1, 54.2) for a suitably adapted tongue (56.1, 562) on the grinding apparatus (10), and wherein the platelike mounting body (44) has at least one protrusion (58), in order in the mounted state to form a frictional engagement connection with a friction face on the grinding apparatus (10).

14. A bearing arrangement for vibratingly supporting a grinding disk (24) on a grinding apparatus (10), in particular in a vibrating grinder, having a plurality of elastic vibration bodies (48), which can be connected to the grinding disk (24) and to the grinding apparatus (10), wherein the vibration bodies (48) are disposed, in groups of a plurality of vibration bodies (48) each, in a plurality of modules (42) that are separate from one another, wherein the individual modules (42) have a bayonet mount for mounting the modules onto the grinding apparatus (10), wherein the individual modules (42) each have one platelike mounting body (44), wherein the vibration bodies (48) are joined together by means of the mounting body (44), and wherein the mounting body (44) has at least one bayonet mount means (54.1, 54.2).

15. The bearing arrangement of claim 1, wherein the vibration body (48) in a couple region (100) in which the vibration body (48) is coupled with a guide body (46) has an increasing diameter (102) a viewed in a direction (104) to the guide body (46).

* * * * *